United States Patent [19]

Edison et al.

[11] 4,194,966

[45] Mar. 25, 1980

[54] APPARATUS AND METHOD FOR IMPROVED FLUID DISTRIBUTION IN A TUBE OF A DIRECT FIRED HEATER

[75] Inventors: Robert R. Edison, Olympia Fields; Thorpe Dresser, Markham, both of Ill.

[73] Assignee: Atlantic Richfield Company, Philadelphia, Pa.

[21] Appl. No.: 925,001

[22] Filed: Jul. 14, 1978

Related U.S. Application Data

[63] Continuation of Ser. No. 745,884, Nov. 29, 1976, which is a continuation of Ser. No. 599,271, Jul. 25, 1975, abandoned.

[51] Int. Cl.[2] ..... C10G 9/14; C10G 9/20

[52] U.S. Cl. ..... 208/132; 122/44 B; 122/235 C; 122/406 B; 138/40; 196/110; 196/116; 196/125; 196/133; 422/204; 422/224; 585/922

[58] Field of Search ..... 422/204, 224; 196/110, 196/116, 117, 123, 125, 126, 133, 137; 208/131, 132, 48 R; 122/44 A, 44 B, 235 C, 406 B, 511; 138/40, 42, 44, 37; 260/683 R

[56] References Cited

U.S. PATENT DOCUMENTS

| | | | |
|---|---|---|---|
| 1,559,701 | 11/1925 | Hirt | 196/110 |
| 2,296,426 | 9/1942 | Coutant | 122/406 B |
| 2,525,276 | 10/1950 | Shapleigh | 196/116 X |
| 3,060,908 | 10/1962 | Brister et al. | 122/235 C |
| 3,089,683 | 5/1963 | Thomas et al. | 259/4 A |
| 3,205,048 | 9/1965 | Elsner | 260/683 R |
| 3,219,483 | 12/1965 | Goose et al. | 259/4 A |
| 3,223,121 | 12/1965 | Lee | 259/4 A |
| 3,274,978 | 9/1966 | Palchik et al. | 196/110 |
| 3,334,971 | 8/1967 | James et al. | 422/224 X |
| 3,361,412 | 1/1968 | Cole | 259/4 AC |
| 3,467,503 | 9/1969 | Juric | 196/110 |
| 3,545,492 | 12/1970 | Scheid, Jr. | 138/42 |
| 3,559,729 | 2/1971 | Radebold | 122/406 B |
| 3,881,688 | 5/1975 | Senn | 259/4 R |
| 3,983,903 | 10/1976 | Kuehn, Jr. | 138/37 X |
| 4,007,014 | 2/1977 | Matsumoto et al. | 422/204 X |

*Primary Examiner*—Michael S. Marcus
*Attorney, Agent, or Firm*—Frank J. Uxa

[57] ABSTRACT

Improved method and apparatus for distributing a fluid, e.g., a liquid-vapor mixture, through a conduit, e.g., a tube in a direct fired heater, involving at least one reduction means located inside the conduit to abruptly reduce the inside cross-sectional area of the conduit available for flow of the fluid, provided that the inside cross-sectional area of the conduit is substantially the same both before and after the reduction means.

4 Claims, 6 Drawing Figures

APPARATUS AND METHOD FOR IMPROVED FLUID DISTRIBUTION IN A TUBE OF A DIRECT FIRED HEATER

This is a continuation of application Ser. No. 745,884, filed Nov. 29, 1976, which in turn, is a continuation of application Ser. No. 599,271, filed July 25, 1975 now abandoned.

This invention relates to an improved apparatus and method for distributing material through a conduit. More particularly, the invention relates to an improved apparatus and method for distributing a fluid, preferably comprising a liquid-vapor mixture, through at least one conduit, e.g., a tube in a direct fired heater, used, for example, in a hydrocarbon conversion process.

In many instances through industry, it is advantageous to distribute a mass of fluid through at least one conduit, e.g., a tube in a direct fire heater. One problem which arises in using such direct fired heaters involves proper flow distribution of the material, in particular, a mixture of liquid and vapor, which is transported through the conduits or tubes of the heater. As the material, which is to be at least partially vaporized and/or heated, flows through the tubes, the distribution of the material in the tube may be such as to result in "dry spots" or "hot spots" at specific areas along the inner wall of the tube. This distribution problem is particularly acute in substantially vertical lengths or segments of the tubes where the fluid flows in a generally upwardly or downwardly direction. These "dry spots" often result from the fluid, e.g., liquid-vapor mixture, flowing in the tube in such a manner so that the liquid substantially by-passes or misses areas along the inner wall of the tube. As these "dry spots" develop, the affected inner wall of the tube becomes overheated and may cause weakening of the tube, and damage to or destruction of the direct fired heater. Therefore, it would be advantageous to provide an improved apparatus for distributing a mass of fluid, e.g., a liquid-vapor mixture, through at least one conduit, e.g., a tube in a direct fired heater.

Therefore, one object of the present invention is to provide an improved apparatus and method for distributing a mass of fluid, e.g., a liquid-vapor mixture, through at least one conduit, e.g., a tube in a direct fired heater.

Another object of the present invention is to provide an improved apparatus and method for processing, e.g., at least partially vaporizing and/or heating, a mass of fluid, e.g., a liquid-vapor mixture, in a direct fired heater. Other objects and advantages will become apparent hereinafter.

An improved apparatus and method for distributing a fluid, preferably a liquid-vapor mixture comprising at least a major portion by weight of liquid (as the fluid enters the conduit), through a conduit has now been discovered. The apparatus comprises at least one reduction means located in the conduit to abruptly reduce the inside cross-sectional area of the conduit available for flow of the fluid, provided that the inside cross-sectional area of the conduit is substantially the same both before and after the reduction means. The term "abruptly reduce" as used herein means that the full reduction in the inside cross-sectional area of the conduit caused by the present reduction means occurs over a length of less than the maximum transverse inside dimension of the conduit not including this reduction means. Preferably, this full reduction occurs over a length of less than about ½, and more preferably less than about ¼, the length of such maximum transverse inside dimension, e.g., width, thickness, diameter and the like.

In a specific aspect, the present invention involves an improved apparatus and method for processing a mass of fluid, preferably a liquid-vapor mixture, in a direct fired heater. Conventionally, such heaters include a hollow vessel, fuel and combustion air inlet means for transporting fuel and combustion air into the hollow vessel, burner means located in the hollow vessel for combining and combusting the fuel and combustion air and at least one tube located inside the hollow vessel in proximity to the combustion of fuel and combustion air so that at least a portion of the heat of combustion is transferred to the tube by radiation. The tube or tubes of the direct fired heater transport the fluid to be processed, e.g., at least partially vaporized and/or heated, in the direct fired heater. The present improvement comprises at least one reduction means located inside at least one of the tubes of the direct fired heater to abruptly reduce the inside cross-sectional area of the tube available for the flow of the fluid, provided that the inside cross-sectional area of the tube is substantially the same both before and after the reduction means.

A plurality of the present reduction means are preferably placed at intervals inside the conduit so that substantially the entire inner wall of the conduit comes in contact with, e.g., is wetted by, the fluid, e.g., the liquid of a liquid-vapor mixture, being distributed and transported. Thus, the present apparatus provides improved fluid distribution through at least one conduit, e.g., tube in a direct fired heater.

The present reduction means act to abruptly reduce the inside cross-sectional area of the conduit available for flow of the fluid. The amount of the reduction of the inside cross-sectional area of the conduit is not critical to the present invention. However, such reduction should be sufficient to provide for distribution of the fluid as it flows through the conduit so that substantially the entire inner wall of the conduit comes in contact with the fluid being distributed and transported. For example, if the conduit is a tube in a direct fired heater, the reduction in inside cross-sectional area should be sufficient to distribute the fluid so as to inhibit the formation of local areas on the tube wall which are at an elevated temperature relative to the temperature of the tube immediately surrounding, e.g., upstream, of such area. Preferably, a temperature difference of at least about 20° F., more preferably at least about 50° F., provides an indication that such a local area, or "hot spot"exists. On the other hand, the reduction in inside cross-sectional area should be such as to avoid detrimental pressure drop across the reduction means. In a preferred embodiment, the pressure drop across each of the present reduction means is less than about 5 psi, more preferably less than about 1 psi. Preferably, the reduction in inside cross-sectional area of the conduit caused by each reduction means ranges from about 5% to about 70%, more preferably from about 10% to about 40%, of the total inside cross-sectional area of the conduit.

The size, e.g., cross-sectional area, length, shape and the like, of the conduits in which the present reduction means may be located is not critical to the present invention. Often the geometry of such conduits depends upon the specific application involved and such factors as the amount of fluid to be processed or transported, desired fluid residence time in the conduit and the like factors. Preferably, these conduits include at least one 90° bend and at least one segment in which the fluid is made to flow in a generally upwardly or downwardly direction. Because of availability and convenience, it is preferred to use conduits having a substantially uniform circular cross-section.

The present reduction means may comprise an insert of any suitable size and shape which can be placed inside the conduit. In a preferred embodiment, the reduction means is attached, e.g., welded, to the inner wall of the conduit.

As noted above, in a preferred embodiment, the present apparatus comprises a plurality of reduction means located at points along the length of the conduit. For example, these reduction means can be placed in the conduit at intervals from about 3 inches or less to about 60 feet or more, preferably from about 1 foot to about 20 feet, of conduit length.

The apparatus of the present invention may be fabricated from any suitable material of construction. The material of construction used is dependent upon the particular application involved. In many instances metals and metal alloys, such as iron, carbon steel or stainless steel, copper and the like, may be used. Of course, the apparatus should be made of a material or combination of materials which is substantially unaffected by the fluid and the conditions, e.g., temperatures, pressures and the like, at which the apparatus is normally operated. In addition, such material or materials should have no substantial detrimental effect on the fluid being processed.

Although the present apparatus and method can be used to distribute fluid through any conduit, the present invention finds particular applicability in distributing fluid comprising a mixture of liquid and vapor (at least at the inlet of the tube containing the present reduction means) through at least one of the tubes of direct fired heaters used, for example, in petroleum and petrochemical processing. The term "direct fired heater" refers to a heater in which the fluid is present in a tube or tubes in the immediate vicinity of which combustion, e.g., of natural gas, hydrocarbon fuel oil and the like, takes place. A significant portion of the heat exchange, e.g., to at least partially vaporize and/or heat the fluid flowing in the tubes, in such a system occurs by radiation. If a direct fired heater system is employed, good distribution of fluid through the tubes is necessary in order, for example, to provide efficient heat exchange and to avoid local "hot spots", noted previously, on tubes which can lead to damage or to even destruction of the heater system.

In a direct fired heater system, tube temperatures may normally range from about 500° F. to about 1600° F. The fluid to be at least partially vaporized and/or heated may enter the direct fired heater at a wide variety of temperatures, for example, from about 100° F. or less to about 1000° F. or more. At least a portion of the liquid in the field is preferably vaporized by the heat transmitted to the direct fired heater. The fluid leaving the tubes of the direct fired heater typically has a temperature ranging from about 200° F. or less to about 1500° F. or more. The amount of heat transferred to the fluid in such a direct fixed heater system may typically range from about 0.5 million BTU/hour or less to about 250 million BTU/hour or more. Tube side pressure drop (from entrance to exit) in a direct fired heater system typically is in the range from about 0.5 psi., to about 100 psi. or more. Operating pressures on the tube side of such a system may range from about 15 psi. or less to about 5000 psi. or more.

Other objects, features and advantages of the present invention will become apparent from the following detailed description of the invention, when considered in conjunction with the accompanying drawings.

Figure 1:
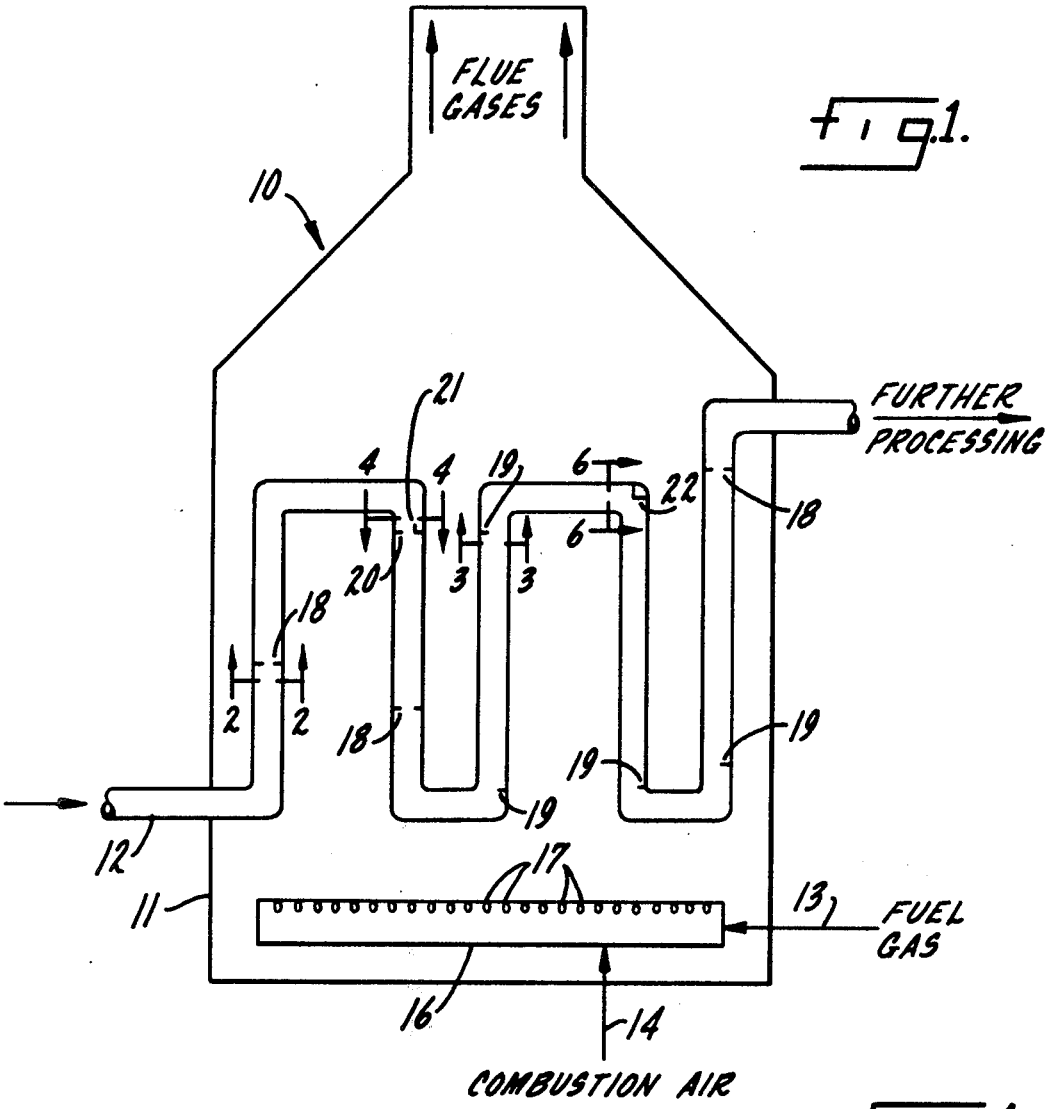
FIG. 1 is a simplified schematic drawing of a direct fired heater employing certain of the improvements of the present invention.

Referring now to the drawings, FIG. 1 shows a direct fired heater referred to generally as 10, which involves a hollow vessel 11; burner base 16, having gas jets 17; and fluid conduit 12. Fuel gas from line 13 and combustion air from line 14 enter direct fired heater 10 to burner base 16. The mixture of fuel gas and combustion air exits through gas jets 17 where it is combusted to produce heat and flue gases which exit through the top of direct fired heater 10. At least a portion of the heat produced by the combustion of the fuel gas combustion—air mixture is transferred, e.g., by radiation, to the fluid flowing in fluid conduit 12. The fluid entering hollow vessel 11 through fluid conduit 12 is a liquid-vapor mixture and is at least partially vaporized by the heat which is transferred to the fluid in direct fired heater 10.

Figure 2:
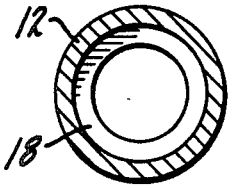
FIG. 2 is a partial bottom elevational view, in section, of the apparatus shown in FIG. 1 taken along line 2—2.
Figure 3:
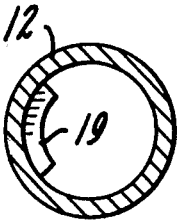
FIG. 3 is a partial bottom elevational view, in section, of the apparatus shown in FIG. 1 taken along line 3—3.

As depicted, fluid conduit 12 involves a series of vertical legs connected by relatively short U-bends. Contained in fluid conduit 12 are a number of reduction means by which the inside cross-sectional area of the conduit available for fluid flow is abruptly reduced. Among these reductions means are included complete baffles 18 which are attached, e.g., welded, to the inner wall of the fluid conduit 12. FIG. 2 illustrates that complete baffle 18 covers the entire inside circumference of fluid conduit 12. Partial baffle 19, which are welded to the inner wall of fluid conduit 12, also acts to abruptly reduce the inside cross-sectional area of the conduit available for fluid flow. Often, these partial baffles 19 make an arc of at least about 60° around the inside circumference of fluid conduit 12.

Figure 4:
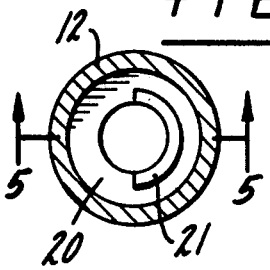
FIG. 4 is a partial bottom elevational view, in section, of the apparatus shown in FIG. 1 taken along line 4–4.
Figure 5:
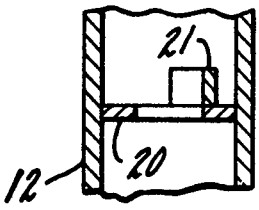
FIG. 5 is a side elevational view, in section, of that portion of the apparatus shown in FIG. 4 taken along line 5—5.

An additional example of the reduction means of the present invention is shown in FIGS. 1, 4 and 5. Thus, this embodiment involves complete baffle member 20, which is welded to the inner wall of fluid conduit 12, and dam member 21, which may be welded to the upper surface of complete baffle member 20 as shown in FIG. 5.

Figure 6:
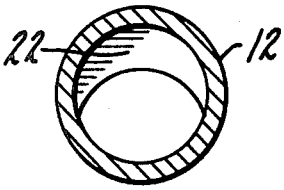
FIG. 6 is a partial side elevational view, in section, of the apparatus shown in FIG. 1 taken along line 6—6.

A still further embodiment of the present reduction means is wedge 22, which is welded to the inner wall of fluid conduit 12. Wedge 22, illustrated in FIGS. 1 and 6 like partial baffles 19 often makes an arc of at least about 60° around the inside circumference of fluid conduit 12. Wedges 22 are particularly useful at points in the fluid conduit 12 when the fluid is in the process of changing directions, e.g., at or near U-bends. The relative thickness of wedge 22 serves to reinforce the fluid conduit 12 against the rush of the fluid as it changes direction.

Each of the reduction means illustrated in the drawings acts to abruptly reduce the inside cross-sectional area of fluid conduit 12 available to fluid flow. The cross-sectional area of fluid conduit 12 is substantially the same both up-stream and down-stream of each of these reduction means.

Direct fired heater 10 may include more than one fluid conduit 12. However, for the sake of illustration, only one fluid conduit 12 has been shown. Using the apparatus as shown in the drawings, the formation of local "dry spots" or "hot spots" on the walls of fluid conduit 12 is inhibited.

The following example illustrates clearly the present invention. However, this example is not to be interpreted as a specific limitation on the invention.

EXAMPLE 1

A direct fired heater, such as shown in FIG. 1 generally as 10, combusts natural gas with combustion air to liberate about 47 million BTU/hr. A mixture of 20,000 barrels per day of petroleum derived liquid gas oil and hydrogen at a hydrogen to hydrocarbon mole ratio of about 6:1 is fed through this direct fired heater 10 wherein the liquid gas oil is heated to a temperature of about 650° F. for further processing in the reaction zone of a conventional hydrocarbon hydrotreating process system. The direct fired heater 10 includes three fluid conduits 12 each of which involves a series of vertical lengths with relatively short U-bends as shown in the drawings. The entire length of each of these fluid conduits 12 is about 675 feet. Each of the fluid conduits 12 is circular in cross-section, having an inside diameter of 8 inches. Each of these fluid conduits 12 includes, at substantially even spaced intervals of 8 feet, compete baffles 18 which are welded to the inner wall of the fluid conduits 12. These complete baffles 18 abruptly reduce the inside cross-sectional area of the fluid conduits 12 available to fluid flow. The complete baffles 18 are ½ inch thick and extend 1 inch from the inner wall of the fluid conduits.

In service, this direct fired heater provides heating service and does not show any indication of local "hot spots" or "dry spots" on the surface of the fluid conduits 12.

As noted and illustrated above, the present invention finds particular application in hydrocarbon, e.g., petroleum, petroleum shale oil, tar sands liquid, coal liquid and the like, processing. Such processing may involve, for example, separation, e.g., simple fractional distillation, extractive distillation and the like, and/or at least one conventional chemical conversion, e.g., hydrotreating, hydrocracking, hydroisomerization, reforming, hydrogenation, hydrodenitrogenation, hydrodesulfurization and the like.

In this regard, the present invention involves a process wherein at least one hydrocarbon product is recovered which includes transferring heat at least partially by radiation to a hydrocarbon liquid-vapor, e.g., hydrogen and/or hydrocarbon-containing vapor, mixture in at least one tube of a direct fired heater. Thus, substantial benefits, e.g., inhibition of "hot spots"formation on the tube wall, are achieved by utilizing at least one reduction means located inside the tube to abruptly reduce the inside cross-sectional area of the tube available to the flow of the liquid hydrocarbon vapor mixture, provided that the inside cross-sectional area of the tube is substantially the same both before and after the reduction means.

The terms "hydrocarbon liquid", "hydrocarbon vapor" and "hydrocarbon product" as used herein refer to materials which comprise a major amount, by weight of carbon and hydrogen. These materials may also include minor amounts, preferably less than about 20% and more preferably, less than about 10%, by weight of one or more other elements, e.g., contaminants, such as sulfur, nitrogen, oxygen and the like, which are chemically combined with the carbon and/or hydrogen.

While this invention has been described with respect to various specific examples and embodiments, it is to be understood that the invention is not limited thereto and that it can be variously practiced within the scope of the following claims.

The embodiments of an invention in which an exclusive property or privilege is claimed are defined as follows:

1. In a process wherein at least one hydrocarbon product is recovered which includes the steps of transferring heat at least partially to a hydrocarbon liquid-vapor mixture flowing in at least one tube of said direct fired heater to vaporize at least a portion of said hydrocarbon liquid within said tube; and recovering at least one hydrocarbon product derived from said liquid-vapor mixture: the improvement which comprises causing said hydrocarbon liquid-vapor mixture to flow through at least one tube of a direct fired heater; abruptly reducing the inside cross-sectional area of said tube available to said flow, and causing said mixture to flow through substantially the same tube inside cross-sectional area both before and after said abrupt reduction, said reduction in cross-sectional area being sufficient to inhibit the formation of local areas of said tube which are at an elevated temperature relative to the temperature of said tube immediately surrounding said areas.

2. The process of claim 1 wherein said liquid-vapor mixture is caused to flow in a generally upwardly or downwardly direction through at least one vertical segment of said tubes and the full reduction in flow area occurs over a length of less than about one-half the maximum transverse inside dimension of said tube.

3. The process of claim 2 wherein said inside cross-sectional area of said tube available for said flow is reduced by an amount equal to about 5% to about 70% of the total inside cross-sectional area of said tube and said reduction is caused by means stationary inside said tube.

4. The process of claim 2 wherein said inside cross-sectional area of said tube available for said flow is reduced by an amount equal to about 10% to about 40% of the total inside cross-sectional area of said tube and said reduction is caused by means stationary inside said tube.

* * * * *